United States Patent [19]

Fujihisa et al.

[11] Patent Number: 4,641,001

[45] Date of Patent: Feb. 3, 1987

[54] CIRCUIT INTERRUPTER

[75] Inventors: Hiroaki Fujihisa, Fukuyama; Hiroshi Fujii, Okayama; Hirotoshi Ohishi; Yoshiaki Kobayashi, both of Fukuyama, all of Japan

[73] Assignee: Mitsubishi Denki Kabushiki Kaisha, Tokyo, Japan

[21] Appl. No.: 723,836

[22] Filed: Apr. 16, 1985

[30] Foreign Application Priority Data

Jun. 15, 1984 [JP] Japan ..... 59-89969[U]
Jun. 15, 1984 [JP] Japan ..... 59-89970[U]

[51] Int. Cl.[4] ..... H01H 3/00

[52] U.S. Cl. ..... 200/153 G; 200/318; 200/327; 335/23; 335/35; 335/175

[58] Field of Search ..... 200/153 G, 318, 327, 200/323-325; 335/21-23, 35, 175, 27, 24, 25, 170, 174, 166-168, 171-172

[56] References Cited

U.S. PATENT DOCUMENTS

| | | | |
|---|---|---|---|
| 2,650,281 | 8/1953 | Norden | 335/35 |
| 2,661,414 | 12/1953 | Casey | 335/35 |
| 2,803,719 | 8/1957 | McDonald | 335/167 |
| 3,774,129 | 11/1973 | Sugiyama | 335/172 |
| 4,023,127 | 5/1977 | Mune | 335/24 |
| 4,376,270 | 3/1983 | Staffen | 335/35 |
| 4,514,709 | 4/1985 | Nakano et al. | 335/23 |

FOREIGN PATENT DOCUMENTS

| | | | |
|---|---|---|---|
| 1904731 | 11/1975 | Fed. Rep. of Germany . | |
| 498327 | 9/1954 | Italy | 335/174 |

*Primary Examiner*—James E. Bryant, III
*Assistant Examiner*—Linda J. Sholl
*Attorney, Agent, or Firm*—Leydig, Voit & Mayer

[57] ABSTRACT

A circuit interrupter comprising a pair of separable contacts at least one of which is movable, and an operating mechanism operatively connected to the movable contacts for opening and closing the contacts. The operating mechanism includes a movable contact arm having mounted thereon the movable contact, a latch lever pivotally mounted on the movable contact arm, and a toggle link mechanism connected at its one end to an operating handle and the other end of which is directly engageable with said movable contact arm and the latch lever. The movable contact arm has a latch surface, and the latch lever has a latching end which, in cooperation with the latch surface, releasably catches the other end of the toggle link mechanism. The operating mechanism further comprises a yieldable member providing a yieldable stop surface for preventing the automatic return movement of the other end of the toggle link mechanism from an extended position after the trip operation to a reset position and for yieldably maintaining the other end of the toggle link mechanism at a position in which the toggle link mechanism is partly collapsed. The yieldable stop surface can be overcome by the manual moving effort on the operating handle.

5 Claims, 7 Drawing Figures

CIRCUIT INTERRUPTER

BACKGROUND OF THE INVENTION

This invention relates to circuit interrupters and more particularly to improvements in an operating mechanism of circuit interrupters.

West German Pat. No. 19 04 731 discloses an electric circuit interrupter in which a movable contact arm having a movable contact is pivoted for opening and closing operation of the circuit interrupter, and the movable contact arm has pivotally mounted thereon a releasable member which is acted by an electromagnetic trip device or a bimetallic thermal trip device to be released for a contact opening operation from the latching action of a latch member. The latching member is pivoted on the movable contact arm with its one end being in the latching engagement with the releasable member and another end thereof is pivotally connected to one end of a toggle mechanism. The other end of the toggle mechanism is pivotally connected to a manually operable operating handle.

When an overcurrent flows through the circuit interrupter, the bimetallic element is heated to deflect to such an extent that the free end of the bimetallic element pushes and rotates the releaseable member from its latching position. As a result the movable contact arm is pivoted to trip open the circuit interrupter. When a massive overload current much greater than the first overcurrent flows through the circuit interrupter in addition to the above-described opening operation due to the deflection of the bimetal element, the electromagnetic trip device generates an electromagnetic force which actuates a magnetic plunger to push and rotate the latch member from its latching position into its tripping position, whih causes the contact opening operation of the circuit interrupter. When it is desired to manually operate the circuit interrupter, the operating handle iof the interrupter is moved. When the handle is operated, the toggle mechanism bridging between the handle and the latch member transmits the handling movement to the latch member and to the movable contact arm to open pivot and the contact of the circuit interrupter.

While this circuit interrupter is quite satisfactory in so far as its operation is concerned, it is desirable to provide a circuit interrupter having an operating mechanism simpler in structure for opening and closing the circuit interrupter contacts. A simple operating mechanism results in a superior interrupting capability and ease in manufacture due to the reduced number of parts constituting the operating mechanism.

In copending U.S. patent application Ser. No. 689,435 filed by the same assignee of the present invention, a new circuit interrupter is proposed which is simple in structure and has improved interrupting capability. According to that application, a circuit interrupter comprises a pair of separable contacts at least one of which is movable, and an operating mechanism operably connected to the movable contacts for opening and closing the contacts. The operating mechanism includes a movable contact arm having mounted thereon the movable contact, a latch member pivotally mounted on the movable contact arm, and a toggle link mechanism connected at its one end to an operating handle and the other end of which is directly engageable with said movable contact arm and the latch member. The movable contact arm has a latch surface, and the latch member has a latching end which, in cooperation with the latch surface, releasably catches the other end of the toggle link mechanism.

However, when the operating mechanism is automatically tripped open by a trip mechanisn by an overcurrent, the latch lever pivots relative to the movable contact arm, permitting the toggle link mechanism to collapse to rotate the operating handle in a position similar to its contact open position. Also, when the operating handle is manually rotated into the contact open position from the contact closed position, the toggle link mechanism can also be collapsed to pull the latching end of the latch lever to separate from the latch surface of the movable contact arm, thereby moving the operating handle in a position similar to its contact open position. That is, the position of the operating handle is the same irrespective of whether the circuit interrupter is tripped open or manually switched open. This is disadvantageous in that the operating handle cannot indicate the exact status of the circuit interrupter, posing a danger that the status of the circuit interrupter is erroneously taken to be the OFF state in which the handle is manually opened when the circuit interrupter is actually tripped open by an overcurrent, resulting in a delay in removing the cause of the overcurrent, or the circuit interrupter is manually reset into the ON state before the cause of the overcurrent has been removed, permitting the flow of the overcurrent thereby damaging the current path and the loads.

SUMMARY OF THE INVENTION

Accordingly, an object of the present invention is to provide a circuit interrupter which is capable of accurately indicating the fact that the circuit interrupter has been tripped open by an overcurrent by the position of the operating handle.

With the above object in view, the present invention resides in a circuit interrupter comprising, a pair of separable contacts at least one of which is movable and an operating mechanism operatively connected to the contacts for opening and closing the contacts, the operating mechanism including a movable contact arm having mounted thereon the movable contact, a latch member pivotally mounted on the movable contact arm, and a toggle link mechanism connected at its one end to an operating handle and the other end of which being engageable with the movable contact arm and the latch member. The movable contact arm has a latch surface and the latch lever has a latching end which, in cooperation with the latch surface, releasably catches the other end of the toggle link mechanism. The operating mechanism further comprises a yieldable stop surface for preventing the automatic return movement of the other end of the toggle link mechanism after the trip operation to the reset position and for yieldably maintaining the other end of the toggle link mechanism at a position in which the toggle link mechanism is partly collapsed, the yieldable stop surface can be overcome by the manual moving effort on the operating handle. The yieldable stop surface may be defined by a resilient metal sheet member extending into the travel path of the other end of the toggle link mechanism. The resilient member may be attached to the interrupter housing or the movable contact arm.

BRIEF DESCRIPTION OF THE DRAWINGS

The present invention will become more readily apparent from the following detailed description of the preferred embodiments of the invention taken in conjunction with the accompanying drawings, in which.

DESCRIPTION OF THE PREFERRED EMBODIMENTS

Figure 1:
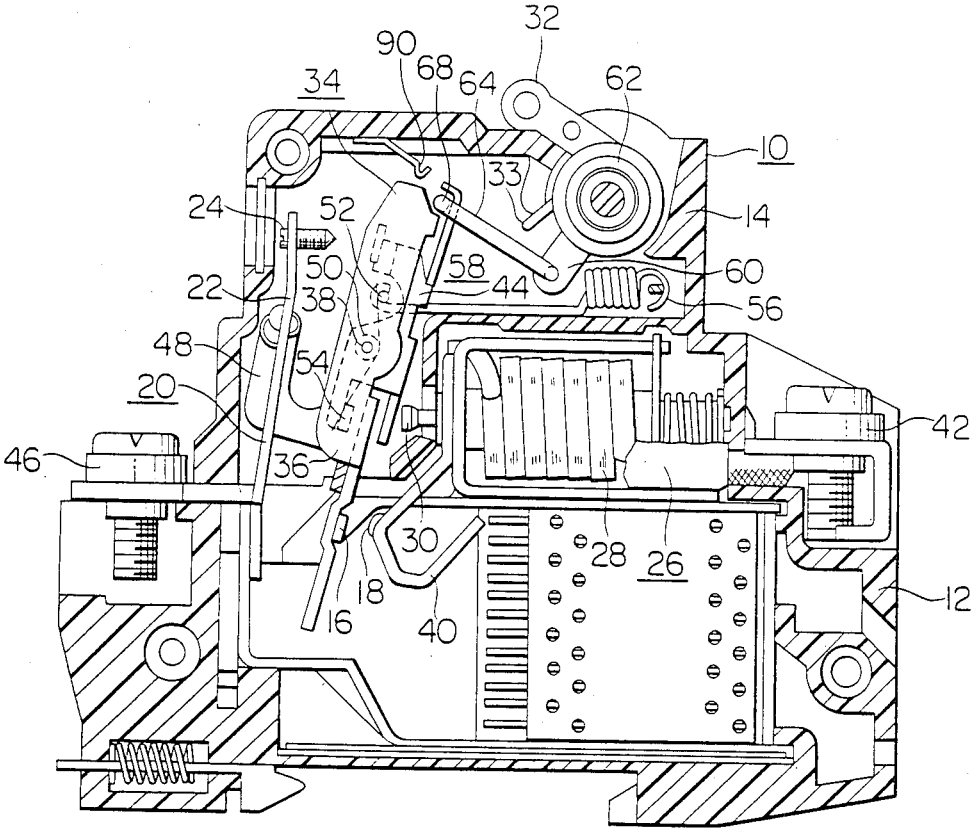
FIG. 1 is a vertical sectional view of a circuit interrupter of one embodiment of the present invention, the circuit interrupter being in the open position.

FIG. 1 shows a circuit interrupter constructed according to the present invention. The circuit interrupter comprises a molded housing 10 formed of a base 12 and a cover 14 each made of an electrically insulating material such as a plastic material. Within the housing 10, a pair of separable contacts 16 and 18, a bimetallic thermal trip device 20 including a bimetallic element 22 and an adjusting screw 24, an electromagnetic trip device 26 including a electromagnetic coil 28 and a plunger 30, an operating handle 32 biased by a torsion spring 33 in the counterclockwise direction in the figure and an operating mechanism 34 having a movable contact arm 36 are disposed.

Contact 16 of the contact pair 16 and 18 is a movable contact, and the other contact 18 is a stationary contact. The movable contact 16 is carried by an end of the movable contact arm 36 pivotally mounted in the housing 10 by a pivot pin 38 so that the pivotal movement of the movable contact arm 36 about the pin 38 causes the movable contact 16 to engage or separate with respect to the stationary contact 18. The stationary contact 18 is supported by a rigid conductor 40 connected to a source side terminal 42 through the coil 28 of the electromagnetic trip device 26 including the plunger 30 which projects from the coil 28 to push a latch member 44 mounted on the movable contact arm 36. The movable contact 16 is connected to a load side terminal 46 through a flexible conductor 48 connected to the contact arm 36 and through the bimetallic element 22 of the thermal trip device 20. Thus, when the contacts 16 and 18 are in contact, an electric current path is provided from the source side terminal 42 to the load side terminal 46 through the coil 28, the rigid conductor 40, the stationary contact 18, the movable contact 16, the movable contact arm 36, the flexible conductor 48 and through the bimetallic element 22.

In accordance with an aspect of the present invention, the movable contact arm 36 of the operating mechanism 34 and the latch member 44 are pivotally supported by the pin 38 fixed on the side walls of the housing 10, and pivotable relative to each other. The pin 38 is wound by a torsion spring 50 which engages at one end thereof with a pin 52 secured on the movable contact arm 36 and at the other end thereof with an extension 54 of the latch member 44. As shown in FIG. 1, the torsion spring 50 biases the latch member 44 to rotate it counterclockwise about the pin 38 with respect to the contact arm 36. The movable contact arm 36 is biased to rotate clockwise as viewed in FIG. 1 by a tension spring 56 mounted between the pin 52 and a pin 57 on the side wall of the housing 10. The operating mechanism 34 further comprises a toggle link mechanism 58 including a first toggle link 60 rigidly and integrally connected at one end to the operating handle 32 which is rotatable about its rotary axis 62 and a second U-shaped toggle link 64 (see FIG. 5) having a first leg or end 66 pivotally connected to the other end of the first toggle link 60. As further seen in FIG. 5 the other latch end 68 of the second toggle link 64 is positioned between "jaws" of the movable contact arm 36 and the latch member 44 or between latch surfaces 72 (FIG. 5) of the latch member 44 and the bent end portion 82 (FIG. 5) of the latch member 44. Thus, in so far as the other end 68 of the second toggle link 64 is rotatable and caught between the "jaws" of the movable contact arm 36 and the latch member 44, this end 68 of the toggle link mechanism 34 held by the "jaws" may be said to be connected to the movable contact arm 36 and the latch member 44.

Figure 2:
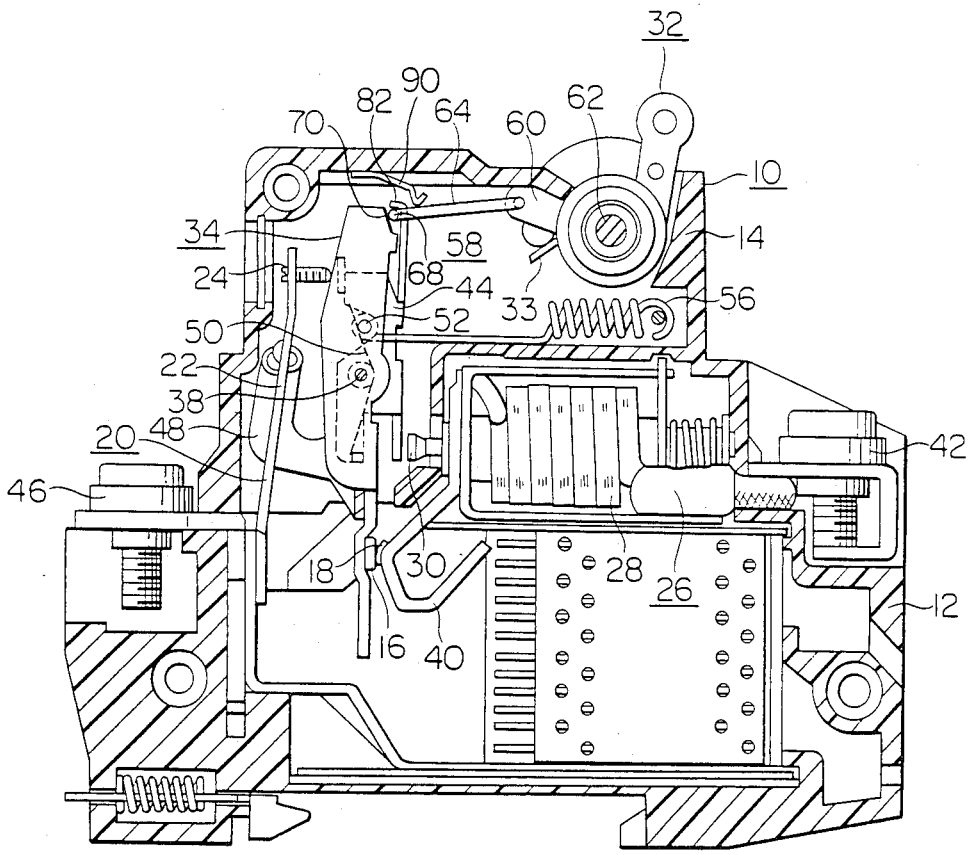
FIG. 2 is a vertical sectional view of the circuit interrupter shown in FIG. 1, the circuit interrupter being in the closed position.
Figure 3:
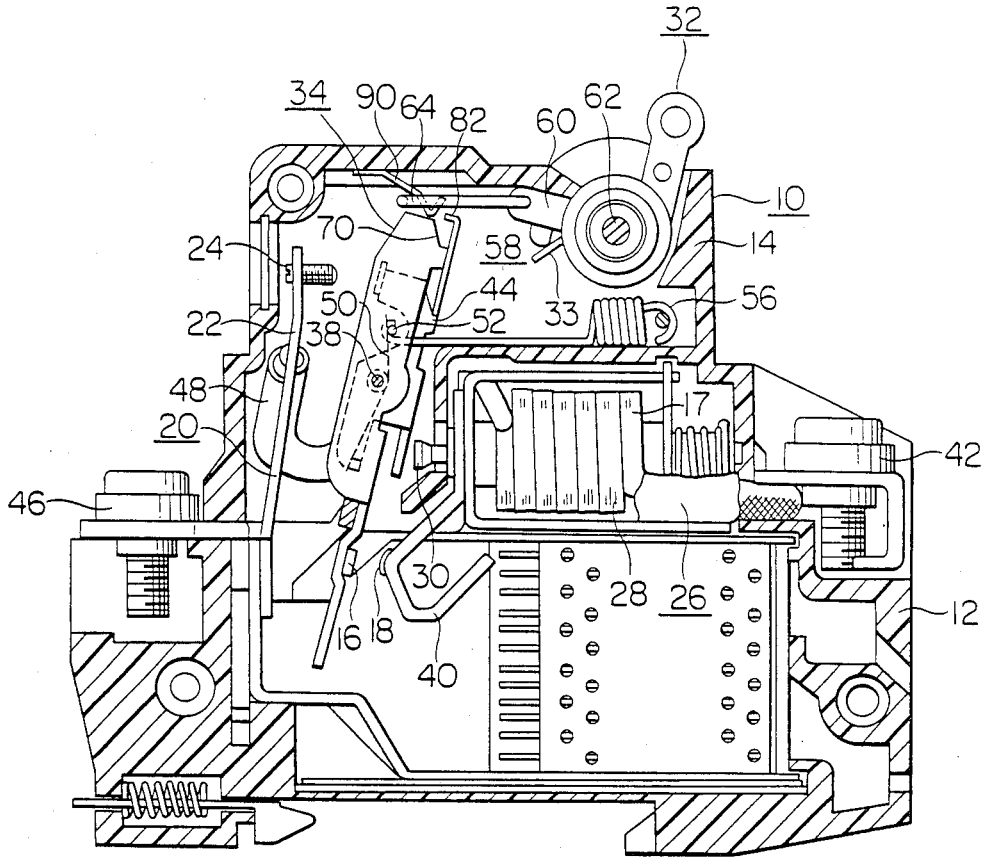
FIG. 3 is a vertical sectional view of the circuit interrupter shown in FIG. 1, the circuit interrupter being in the state immediately after tripped open.
Figure 4:
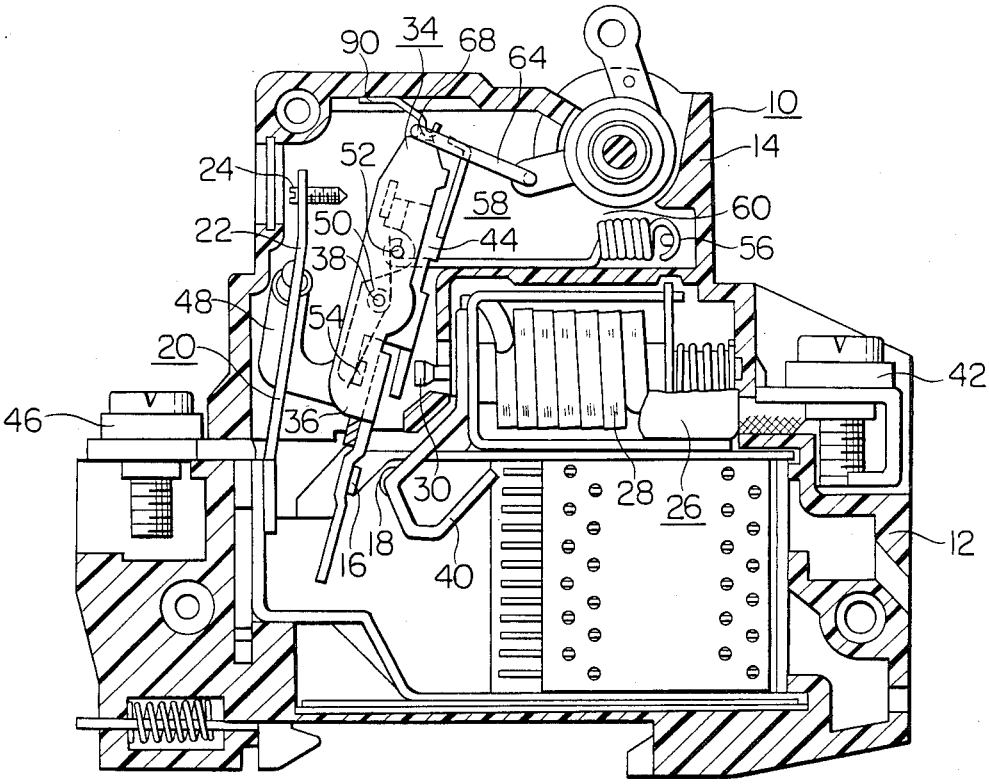
FIG. 4 is a vertical sectional view of the circuit interrupter shown in FIG. 1, the circuit interrupter being in the tripped position in which the operating mechanism including the operating handle is yieldably maintained in the trip position.

It is also seen from FIGS. 1 to 5, the circuit interrupter of the present invention comprises a stop 90 made of a resilient metallic sheet material. The stop 90 is secured at its base end 92 to the inner surface of the top wall of the housing cover 14 by an suitable securing means such as screws (not shown) and the other end 94 which is a free end of the stop 90 projects at the projection 96 into the travel path of the other end 68 of the toggle link mechanism 58. The projection 96 of the stop 90 is configured and positioned with respect to the latch surface 72 and the guide surface 74 (see FIG. 5) of the movable contact arm 36 such that the projection 96 provides a yieldable stop surface 98 for preventing an automatic return movement of the other end 68 of the toggle link mechanism 58 after the trip operation to the reset position and for yieldably maintaining the other end 68 of the toggle link mechanism 58 at a position in which the toggle link mechanism 58 is partly collapsed as shown in FIG. 4 and will be described in detail later. The spring force of the resilient stop 90 is selected such that the yieldable stop surface 98 is capable of being overcome by the manual moving effort exerted on the operating handle 32.

Figure 5:
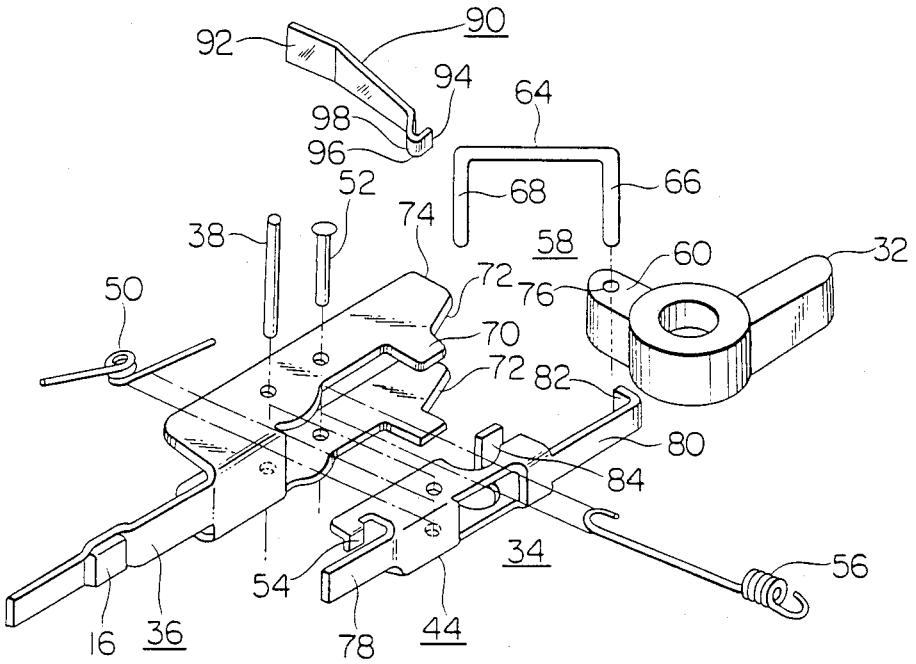
FIG. 5 is an exploded perspective view of the operating mechanism of the circuit interrupter shown in FIGS. 1 to 4.

As is best seen from FIG. 5, in which the components constituting the operating mechanism 34 are illustrated in an exploded perspective view, the movable contact arm 36 is a member made of a bent metallic sheet material including a portion supporting the movable contact 16 and a pair of spaced parallel portions between which the latch member 44 is received. Each of the tips of the parallel portions has formed thereon a stop 70 projecting toward the latch member 44 for engagement with the latch member 44, a latch surface 72 for latching, in cooperation with the tip of the latch member 44, the latch end 68 of the toggle link 64 of the toggle link mechanism 58, and a guide surface 74 for supporting and guiding the latch end 68 of the toggle link 64 of the toggle link mechanism 58.

When assembled, the first end 66 of the second toggle link 64 is rotatably held in a hole 76 formed in the first toggle link 60 which is an integral portion of the operating handle 32, and the second end 68 is placed against the latch surface 72 of the movable contact arm 36.

The latch member 44 also is a bent metallic sheet member adapted to be received between the pair of spaced parallel portions of the contact arm 36. The latch member 44 has a tongue 78 at which the plunger 30 of the electromagnetic trip device 26 makes contact when activated, an elongated L-shaped latch 80 including a bent tip 82 and a tab 84 adapted to be pushed by the adjusting screw 24 of the bimetallic trip device 20. In the assembled state shown in FIG. 1, the latch member 44 is biased by the torsion spring 50, which engages the pin 52 on the contact arm 36 and the extension 54 of the latch member 44, and the elongated latch 80 is pressed against the stops 70 of the movable contact arm 36. It is to be noted that the bent end 82 of the latch member 44, the strength of the torsion spring 50, and the configuration of the latch face 72 are so selected that the second latch end 68 of the second toggle link 64 is caught between the bent tip 82 of the latch member 44 and the edges 70 and 72 of the movable contact arm 36 when the circuit interrupter is in the closed position as shown in FIG. 2.

In operation, the circuit interrupter may be manually brought into closed position as shown in FIG. 2 by turning the operating handle 32 into the ON position shown in FIG. 2 from the OFF position shown in FIG. 1. The clockwise rotation of the handle 32 against the action of the spring 56 causes the second latch end 68 of the second toggle link 64 to push the edges or the latch surfaces 72 (FIG. 5) of the movable contact arm 36 to rotate the movable contact arm 36 about the pin 38 in the counterclockwise direction against the action of the spring 56, thereby causing the movable contact 16 to engage with the stationary contact 18 as shown in FIG. 2. During this movement of the movable contact arm 36, a toggle knee point, which is on the first end 66 of the second toggle link 64 pivotally inserted into the first toggle link element 60 on the handle 32, moves across the center of the action of the toggle link mechanism 58 and the toggle knee point or the first end 66 of the second link 64 is pushed against the top wall of the cover 14 of the housing 10, whereby the toggle mechanism 58 and therefore the operating mechanism 34 is locked in this closed position.

When an overcurrent of a relatively low level flows through the circuit interrupter in the contact closed position (FIG. 2), the thermal trip device 20 is actuated to push the tab 84 on the latch member 44 against the action of the torsion spring 50 to rotate clockwise the latch member 44 relative to the movable contact arm 36. This rotation of the latch member 44 causes the "jaw" of the latch mechanism 34 or the engaging surfaces 70, 72 of the contact arm 36 and the bent end 82 of the latch member 44 to open to release the second latch end 68 of the second toggle link element 64. Therefore, the toggle link second latch 68 is allowed to slip out from the "jaw" to allow the movable contact arm 36 to be released under the action of the tension spring 56 which causes the clockwise rotation of the movable contact arm 36 and the latch member 44 due to the spring 56, whereby the movable contact 16 separates from the stationary contact 18 as illustrated in FIG. 3 to interrupt the overcurrent. During this operation, the smooth disengaging movement of the second end 68 of the toggle link element 64 from the latch surface 72 is not impeded by the resilient stop 90 because the stop 90 is so arranged that the projection 96 is separated from the movable contact arm 36 by a sufficient distance for allowing the passage of the second toggle link end 68 in the contact closed position shown in FIG. 2. Immediately after the toggle link 64 is released and the contacts 16 and 18 are opened as shown in FIG. 3, the operating handle 32 rotates counterclockwise due to the torsion spring 33. This rotation of the handle 32 causes the second end 68 of the toggle link 64 to be moved in the right in FIG. 3 toward the contact open position illustrated in FIG. 1 in which the second end 68 of the toggle link 64 is inserted into the "jaw" or the space between the engaging surfaces 70 and 72 of the movable contact arm 36 and the bent end portion 82 of the latch member 44.

However, the yieldable stop surface 90 of the projection 96 of the stop 90 acts as a stop for preventing further movement of the second end 68 in the right as viewed in FIG. 4 beyond the illustrated position, thus preventing the toggle link mechanism 58 from completely collapsing to rotate the operating handle 32 in the counterclockwise direction from the closed position to the open position and holding the toggle link mechanism 58 in the position illustrated in FIG. 4 in which the operating handle 32 is positioned about midway between the contact open position shown in FIG. 1 and the contact closed position shown in FIG. 2, whereby the operating handle 32 clearly indicates that the operating mechanism 34 is in the tripped position. It is seen that the toggle link mechanism 58 is partly collapsed in this tripped position shown in FIG. 4.

When a very severe overcurrent flows through the circuit interrupter in the closed position shown in FIG. 2, the plunger 30 of the electromagnetic trip device 26 instantaneously projects from the coil 28 due to the electromagnetic force generated by the overcurrent. The plunger 30 thus pushes the tongue 78 of the latch member 44 to rotate the latch member 44 clockwise about the pin 38 with respect to the movable contact arm 36 against the action of the torsion spring 50. This clockwise rotation of the latch member 44 causes the operating mechanism 34 of the circuit interrupter to achieve the same trip operation as discussed above in conjunction with the relatively low overcurrent condition to interrupt the current flowing through the circuit interrupter, and the fact that the circuit interrupter is tripped is displayed by the position of the operating handle 32 shown in FIG. 4.

When it is desired to reset or return the circuit interruter to the contact closed position shown in FIG. 2 from the trip position shown in FIG. 4, the operating handle 32 is manually rotated clockwise from the trip position shown in FIG. 4 against the blocking action of the yieldable stop surface 98 of the resilient stop 90. Then the other end 68 of the toggle link 64 pushes off the yieldable stop surface 98 from the travel path of the latch end 68 of the toggle link 64 against the resiliency of the stop 90, thereby making the yieldable stop surface 98 ineffective as a stop surface. Therefore, the latch end 68 of the toggle link 64 is permitted to move into the contact open position shown in FIG. 1 from which the operating handle 32 can be rotated in the clockwise direction to move the operating mechanism 34 into the contact closed position shown in FIG. 1.

Figure 6:
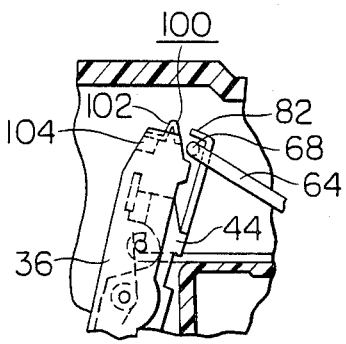
FIG. 6 is a fragmental sectional view showing the movable contact arm with the yieldable stop of another embodiment of the present invention.
Figure 7:
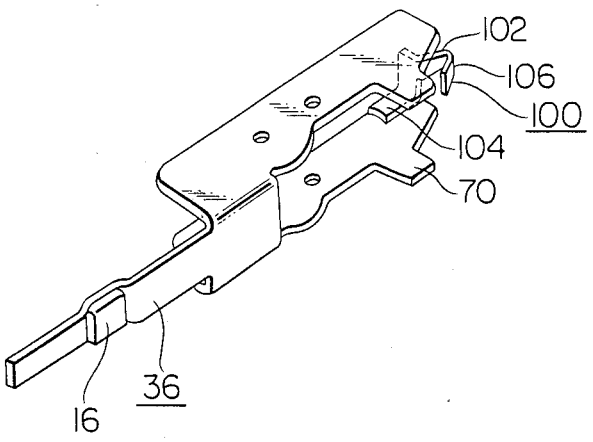
FIG. 7 is a perspective view of the movble contact arm shown in FIG. 6.

FIG. 6 is a fragmental sectional view illustrating the pertinent portion of the operating mechanism 34 of the another embodiment of the present invention in which it is seen that the movable contact arm 36 is provided with a yieldable stop 100 defining a yieldable stop surface 102 having a similar function to that of the yieldable stop surface 98 of the stop 90. FIG. 7 is a perspective exploded view of the movable contact arm 36 of the embodiment shown in FIG. 6. In this embodiment, the resilient stop 100 defining the yieldable stop surface 102 is mounted on the movable contact arm 36 rather than on the housing as is in the previously described embodiment. As shown in FIGS. 6 and 7, the resilient stop 100 is made of a resilient metallic sheet material and has at one end a base 104 welded to the movable contact arm 36 and at the other end a projection 106 defining the a yieldable stop surface 102 projecting into the path of movement of the latch end 68 of the toggle link element 64. It will be easily understood that the operating mechanism including the yieldable stop 100 attached to the movable contact arm 36 operates similarly to the previously embodiment.

What is claimed is:

1. A circuit interrupter comprising:

a pair of separable contacts, at least one of which is movable;

an operating handle for manually operating said interrupter, and an operating mechanism operatively connected to move said movable contact relative to the other contact for opening and closing said circuit interrupter;

said operating mechanism including:

a movable contact arm carrying said movable contact at one end and providing a latch surface at the other end;

a latch member pivotally mounted on said movable contact arm and having a latching end spaced from said latch surface to form a jaw therebetween;

a toggle link mechanism including a first link connected to said operating handle and a second link having one end pivotally connected to said first link and a second end, said toggle link mechanism having an extending position corresponding to an open contact position of said handle and a collapsed position corresponding to a closed contact position of said handle, said second link being adapted to be received and held in said jaw by engagement with said latching end and said latching surface to operate said movable contact arm to manually open and close said contacts by said interrupter upon movement of said handle between open and closed positions, said second end of said second link being slidably released from said jaw by coaction with said latch surface upon movement of said latching end away from said latch surface which is caused by said operating mechanism when said interrupter is tripped; and means including a yieldable member providing a yieldable stop surface for preventing return movement of said toggle link mechanism from said extended position after the trip operation to a reset position and for yieldably maintaining said toggle link mechanism at a position in which said toggle link mechanism is partly collapsed, said yieldable member being adapted to yield in response to manual effort on said operating handle to release said toggle link mechanism for return movement.

2. A circuit interrupter as claimed in claim 1 wherein said yieldable stop surface is defined by a resilient metal sheet member extending into the travel path of said other end of said toggle link mechanism.

3. A circuit interrupter as claimed in claim 2 wherein said resilient member is attached to said housing.

4. A circuit interrupter as claimed in claim 2 wherein said resilient member is attached to said movable contact arm.

5. A circuit interrupter as claimed in claim 1 wherein said second link comprises a substantially U-shaped rod, and said one end and said second end of said second link are legs of the U-shaped rod.

* * * * *